US007578101B2

(12) United States Patent
Ganske

(10) Patent No.: US 7,578,101 B2
(45) Date of Patent: Aug. 25, 2009

(54) SUPPORT BRACKET TO SUSPEND SHEET MATERIAL FOR A WALL

(76) Inventor: Roger Howard Ganske, 42 Rossdale Road, S.W., Calgary, AB (CA) T3C 2P2

( * ) Notice: Subject to any disclaimer, the term of this patent is extended or adjusted under 35 U.S.C. 154(b) by 105 days.

(21) Appl. No.: 11/627,737

(22) Filed: Jan. 26, 2007

(65) Prior Publication Data

US 2007/0114347 A1 May 24, 2007

Related U.S. Application Data

(63) Continuation-in-part of application No. 10/857,639, filed on May 27, 2004, now abandoned.

(51) Int. Cl.
*E04G 21/04* (2006.01)

(52) U.S. Cl. ..... 52/127.2; 248/544

(58) Field of Classification Search ..... 248/544, 248/300, 301, 304; 52/127.1, 127.2, 127.8, 52/127.9, 713, 745.12, 747.1, 749.1, 768, 52/489, DIG. 1; 269/6, 43, 46, 95, 102
See application file for complete search history.

(56) References Cited

U.S. PATENT DOCUMENTS

| | | | | | |
|---|---|---|---|---|---|
| 770,050 | A * | 9/1904 | Dreyer | 403/190 |
| 3,662,509 | A * | 5/1972 | Studzinski | 52/404.1 |
| 3,895,471 | A * | 7/1975 | Kolb | 405/227 |
| 4,089,141 | A * | 5/1978 | Heroux | 52/105 |
| 4,093,168 | A * | 6/1978 | Buril | 248/220.41 |
| 4,164,346 | A * | 8/1979 | Sickler | 269/289 MR |
| 4,449,338 | A * | 5/1984 | Reicherts | 52/127.8 |
| 5,249,405 | A * | 10/1993 | Miller | 52/712 |
| 5,371,994 | A * | 12/1994 | Waters | 52/749.1 |
| 5,564,236 | A * | 10/1996 | McKinney et al. | 52/127.2 |
| 6,129,225 | A | 10/2000 | Giannoglou et al. | |
| 6,131,361 | A * | 10/2000 | Murphy | 52/712 |
| 6,266,937 | B1 * | 7/2001 | Watanabe | 52/489.2 |
| 6,293,058 | B1 * | 9/2001 | Sink | 52/127.1 |
| 6,315,489 | B1 * | 11/2001 | Watanabe | 403/381 |
| 6,595,476 | B1 * | 7/2003 | Edwards | 248/200.1 |
| 6,622,438 | B2 * | 9/2003 | Hurlock | 52/127.2 |

(Continued)

FOREIGN PATENT DOCUMENTS

| | | |
|---|---|---|
| CA | 2052996 | 4/1992 |

*Primary Examiner*—Korie H. Chan
(74) *Attorney, Agent, or Firm*—Dennis T. Griggs; Scott T. Griggs; Griggs Bergen LLP

(57) ABSTRACT

A bracket has outwardly projecting L-shaped support arms for use in installing sheet material, such as drywall or sheetrock, on a wall. The bracket includes a base having holes for temporarily fastening the bracket to a stud of the wall. The support arms of the bracket extend horizontally from the bracket to support the edge of sheet material. When a pair of brackets is installed on the studs of a wall to be covered with sheet material, a single person can install the sheet material on a wall by first resting the sheet on the support arms of the brackets and then easily positioning and fastening the sheet to the wall. The brackets can then be removed and be reused to install sheet material on another section of wall. The bracket further includes a flange that is easily grasped by either hand when installing or removing the bracket.

7 Claims, 6 Drawing Sheets

U.S. PATENT DOCUMENTS 6,691,992 B1 * 2/2004 Mungo ..... 269/43
6,904,732 B1 * 6/2005 Richmond ..... 52/749.1
2005/0155307 A1 7/2005 Timony

* cited by examiner

SUPPORT BRACKET TO SUSPEND SHEET MATERIAL FOR A WALL

CROSS REFERENCE TO RELATED APPLICATIONS

This application is a continuation-in-part of co-pending U.S. application Ser. No. 10/857,639 entitled "Support Bracket to Suspend Sheet Material for a Wall," filed May 27, 2004, by Roger Howard Ganske.

BACKGROUND OF THE INVENTION

1. Field of the Invention

The present invention relates to a bracket that may be temporarily attached to a vertical stud for the purpose of supporting a sheet of building material, to assist the installer as he secures the sheet to the stud.

2. Description of the Related Art

It is known to provide a bracket for temporary installation on vertical support members, such as wall frame studs that form part of a wall. Examples are disclosed in published Canadian patent application No. 2,052,996 and U.S. Pat. No. 4,449,338.

However, such known devices are relatively complex and cumbersome to use and are not ideally suited for use with both wooden and metal studs commonly used in building construction.

BRIEF SUMMARY OF THE INVENTION

A bracket is provided for use in the installation of sheet material, such as drywall or sheetrock, on stud-framed walls or structures. Those skilled in the art understand that the studs used in these walls or structures can be used in a vertical orientation and can be made of wood or metal, having a nominal or approximate width of 2 inches. The studs can be spaced, nominally, anywhere from 12 inches to 24 inches apart. For the purposes of this specification, the width of a stud can range from a finished width of 1½ or 1⅝ inches (as can be used on studs in typical residential or commercial building construction) to up to 12 inches (as can be used on metal studs used in load-bearing walls or structures). Those skilled in the art also understand that metal studs can have a C-shaped cross-section.

In one embodiment, the bracket has a flat base which can be readily applied to abut the side surface of a vertical stud. The base is intersected by holes through which fasteners may be driven into the stud to firmly attach the bracket to the stud. A pair of vertically spaced apart, horizontal, outwardly projecting, oppositely directed L-shaped support arms are formed on the base. In another embodiment, the bracket is an integral unit formed of injection molded plastic. The support arms are preferablyjoined along one side by a first flange that extends outwardly and away from the base for reinforcing the arms.

In another embodiment, a second flange is provided on the bracket as means for grasping the bracket. The second flange extends outwardly and away from the first flange such that the second flange is generally perpendicular to the first flange. By providing a pair of oppositely directed L-shaped support arms, a first flange and a second flange in this configuration, the bracket is adapted for use by either right- or left-handed users.

In the installation of drywall panels on a wall frame, it is often preferable to install the sheets in a horizontal orientation to minimize the number of joints to be taped. This is especially true on longer walls where it is possible to use longer lengths of drywall panels; for example, 10, 12 or 14-foot long sheets of drywall that are typically 4-feet wide. When installing drywall sheets in this fashion, it is customary to start from the ceiling and work downwards to the floor. This requires the handling and positioning of the drywall sheet against the stud frame so that the drywall sheet is flush with the ceiling and any adjoining wall.

These longer lengths are often too heavy to be handled by a single installer so at least one other person is needed to help position the sheet on the wall frame during its installation. By using the bracket as described above, it is possible for a single installer to install sheet material without the assistance of another person.

In one embodiment, the bracket is used by temporarily screwing the bracket to a stud at an appropriate height on the stud so it may be used as a support for the sheet material. A second bracket can be installed on another stud along the wall at a similar height so that the sheet material can be supported by the brackets at or near the position the sheet material is to be installed on the wall.

With the brackets holding the sheet material at or near its intended installed position, the installer can move the sheet to its final position and fasten the sheet to the studs until it is securely attached to the wall frame. The brackets can then be removed from the studs and be re-attached at another section of wall studs if additional sheets of material are to be installed. This is repeated until the installer has completed covering the wall with sheet material.

To keep the cost of the bracket affordable and to keep its manufactured cost low, the bracket can be made of injection molded plastic.

In another embodimnent, a wedge can be used with the bracket to position the sheet material to its final position before being fastened to the wall. After the sheet is placed on a pair of brackets temporarily fastened to studs forming part of the wall, a wedge can be inserted between the bottom edge of the sheet and one bracket to shim the sheet up to an installation position. In yet another embodiment, a second wedge can be used in a similar fashion with the second bracket to move the sheet to the installation position. After the sheet is fastened to the wall, the wedges are removed along with the brackets for use at another location. In still another embodiment, external lifting devices known to those skilled in the art, such as a "deadman" or a "t-lift", can also be used to raise the sheet from the brackets into its installation position.

Broadly stated, a method is provided for installing sheet material at an elevated position on a wall frame of the type including one or more wall frame studs with the assistance of a bracket having an elongate base, an upper end, a lower end and a contact surface extending therebetween for abutting against a wall frame stud. The base has a width that substantially corresponds to the width of the wall frame stud and is intersected by one or more holes through which a fastener can be driven into the wall frame stud to attach the bracket to a wall frame stud. A first L-shaped support arm disposed on the base, the first support arm extending outwardly and away from the upper end of the base. The first support arm is dimensioned to support a sheet of drywall material in an angular pre-installation position. This bracket is fastened to the wall frame stud with the fastener being driven through the hole into the wall frame stud whereby the support arm is extended outwardly from the upper end of the base. The sheet material is placed on the bracket whereby the lower edge of the sheet material is resting on the support arm at a pre-installation position. The sheet material is moved to its installation position and is then fastened to the wall frame.

Broadly stated, a kit is provided for use in installing sheet material at an elevated position on a wall frame of the type including one or more wall frame studs. The kit includes at least one bracket having an elongate base having an upper end, a lower end and a contact surface extending therebetween for abutting against a wall frame stud. The base has a width that substantially corresponds to the width of the wall frame stud. The base is intersected by one or more holes through which a fastener can be driven into the wall frame stud to attach the bracket to the wall frame stud. A first L-shaped support arm is disposed on the base and extends outwardly and away from the upper end of the base. The first support arm dimensioned to support the sheet material in an angular pre-installation position when the lower edge of the sheet material is placed on top of the first support arm; and at least one fastener is provided for driving through the hole into the wall frame stud.

Broadly stated, a bracket is provided as an aid for temporarily attaching sheet material to a wall frame of the type including one or more wall frame studs and supporting the sheet material at an elevated position on the wall frame. The bracket includes an elongate base having an upper end, a lower end and a contact surface extending therebetween for abutting against the wall frame stud. The base has a width that substantially corresponds to the width of the wall frame stud. The base is intersected by one or more holes through which a fastener may be driven into a wall frame stud to attach the bracket to the wall frame stud on a temporary basis. A first L-shaped support arm is disposed on the base and projects outwardly from the upper end and away from the base. The support arm is dimensioned to support sheet material in an angular pre-installation position when the bracket is temporarily attached to the wall frame stud.

DETAILED DESCRIPTION OF EMBODIMENTS

Figure 1:
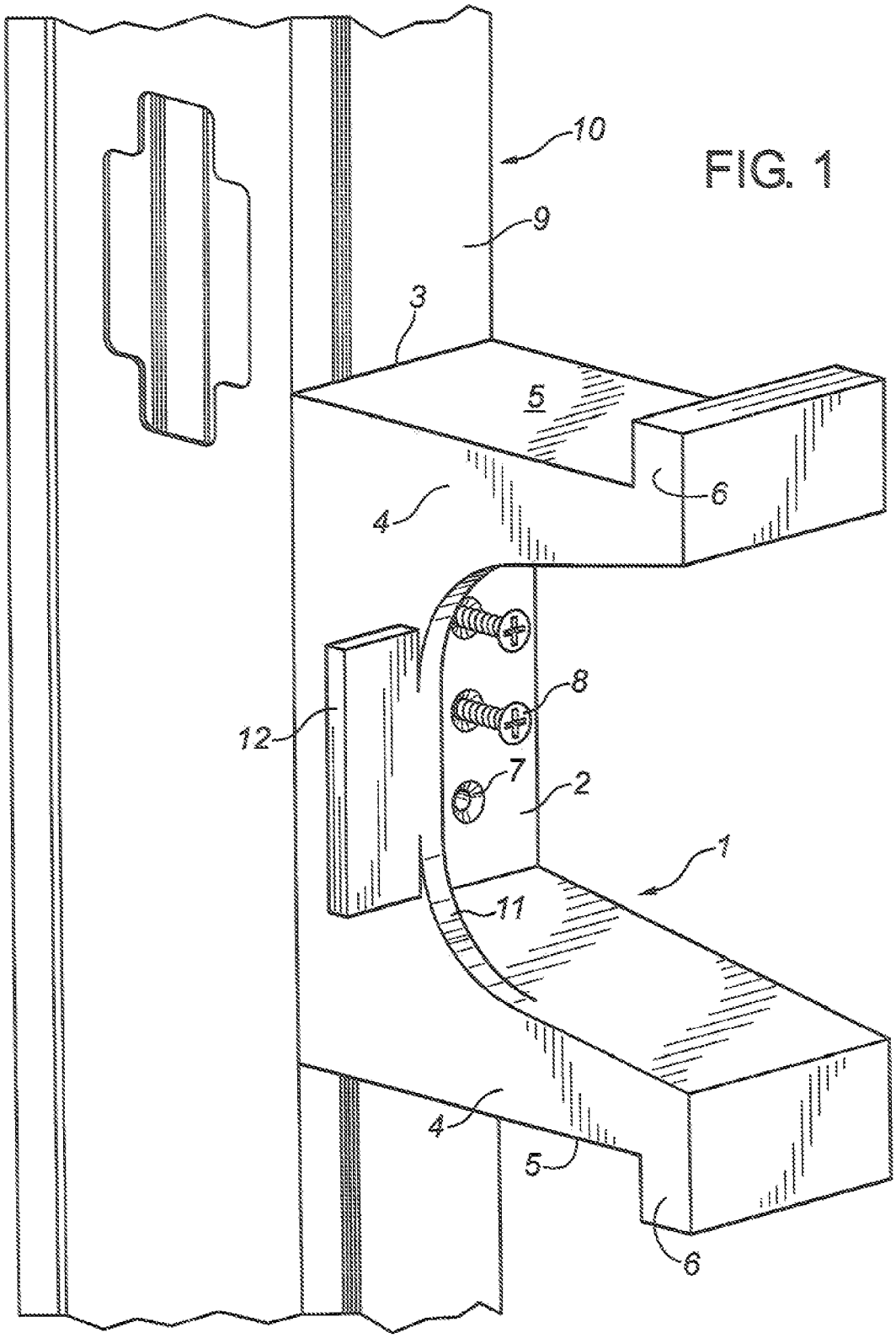
FIG. 1 is a perspective view depicting a bracket mounted to the side surface of a C-shaped stud.

As shown in FIGS. 1 and 3 to 6, bracket 1 comprises a flat rectangular base 2 having a bottom stud contact surface 3. A pair of vertically spaced apart, horizontal, oppositely directed, L-shaped support arms 4 project forwardly from the base 2. Support arms 4 each provide a panel-supporting surface 5 and a panel-retaining lip 6.

Through-holes 7 are formed in base 2, through which fasteners 8 may be driven to affix the bracket 1 onto the side surface 9 of stud 10. As shown in FIG. 1, base 2 is elongate in shape having a width narrower than its height. In the illustrated embodiment, the width of base 2 substantially corresponds to, or is approximately the same as, the width of side surface 9 of stud 10. In a representative embodiment, the width of base can range approximately from 1½ inches to 2 inches although it should be obvious to those skilled in the art that the width of base 2 can be of any suitable width outside of this representative range and still be easy to manipulate by an installer to temporarily fasten bracket 1 to stud 10.

In one embodiment, a first flange 11 protrudes forwardly from base 2 and joins support arms 4 at their lower ends at one side as shown in FIG. 1. Flange 11 functions as a gusset to reinforce support arms 4. In another embodiment, a second flange 12 can be provided that projects sideways from first flange 11, to provide means for an installer to grasp and firmly hold bracket 1. In a representative embodiment, second flange 12 extends generally perpendicular to first flange 11. Second flange 12 permits an installer to grasp and locate bracket 1 with one hand while grasping a manual or power assisted driving tool with the other hand to affix bracket 1 to stud 10 by driving fastener 8 through hole 7 into stud 10.

In use, base 2 is vertically applied, as shown in FIG. 1, to bring stud contact surface 3 into abutment with side surface 9 of stud 10. Fasteners 8 can then be driven through holes 7 to affix bracket 1 firmly to stud 10. One upwardly directed support arm 4 then provides a panel-supporting surface 5 to suspend panel 13 and also provides lip 6 for unassisted support of panel 13 when panel 13 is disposed in an angular pre-installation position, as shown in FIG. 2A.

In the illustrated embodiment, fasteners 8 are threaded fasteners such as self-tapping screws used for fastening drywall to stud-framed walls as well known to those skilled in the art. Those skilled in the art will recognize that non-threaded fasteners can be used to temporarily attach bracket 1 to studs 10, an example of which includes, but is not limited to, nails to attach bracket 1 to studs made of wood. In use, an installer could simply nail bracket 1 to stud 10 by driving nails through holes 7. To remove bracket 1, the user would pry bracket 1 away from stud 10 to loosen the nails. In another embodiment, double-headed nails could be used that can be removed using a pry bar or a claw-head hammer.

Figure 2A:
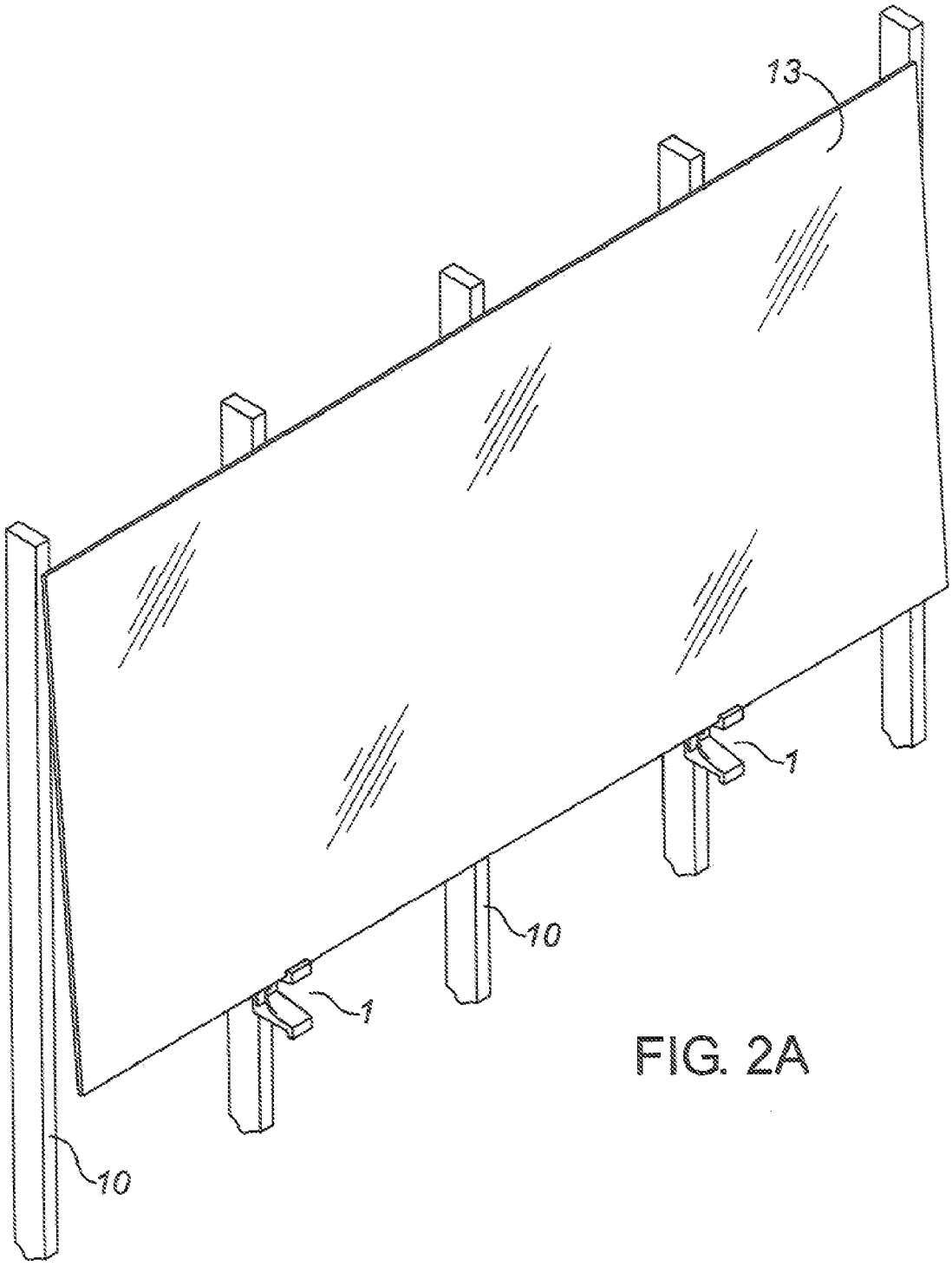
FIG. 2A is a perspective view depicting a building material sheet resting on a pair of brackets mounted to studs, prior to securing the sheet to the vertical studs.
Figure 2B:
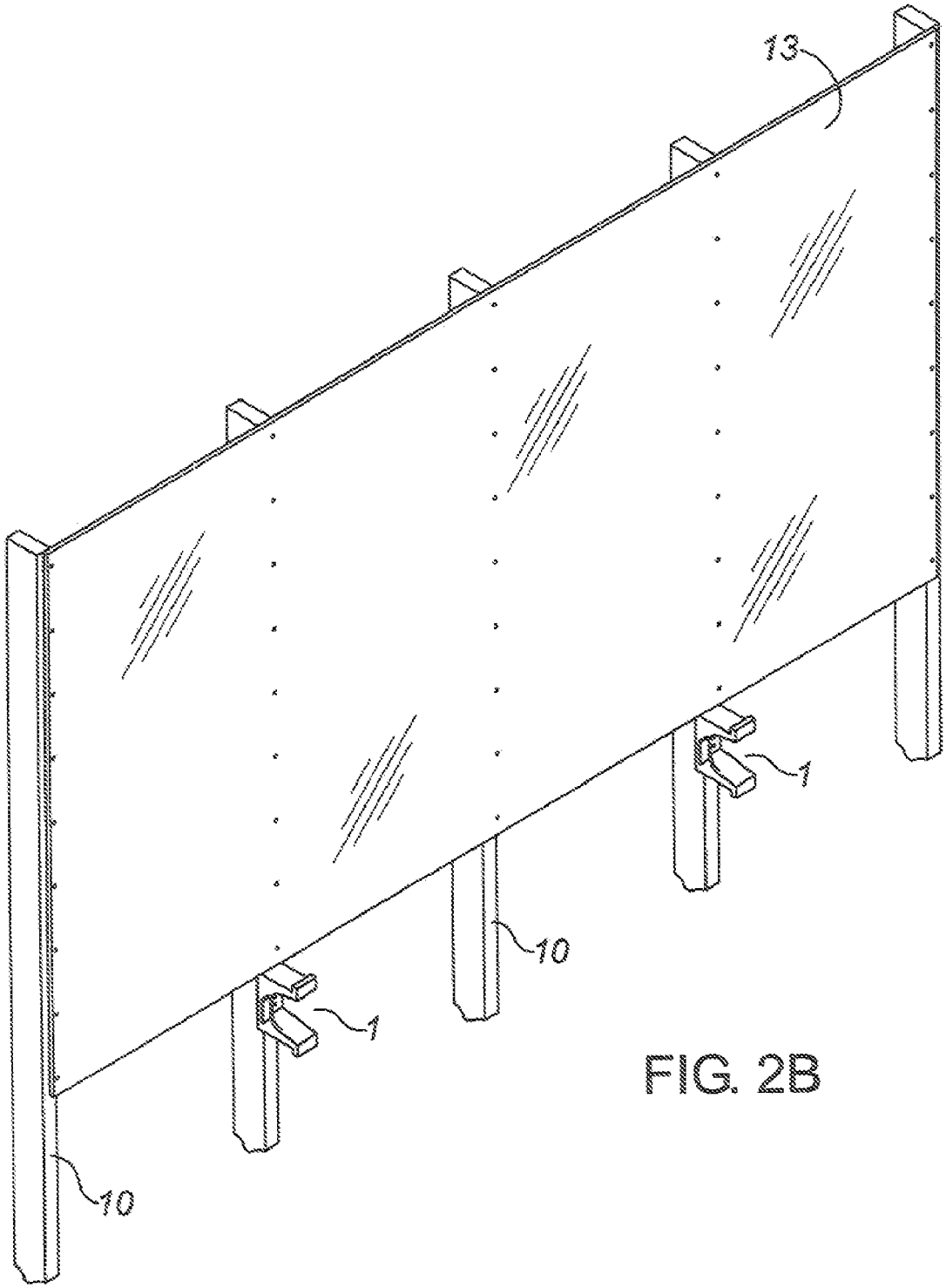
FIG. 2B is a perspective view depicting the building material sheet of FIG. 2A fastened to the studs.
Figure 3:
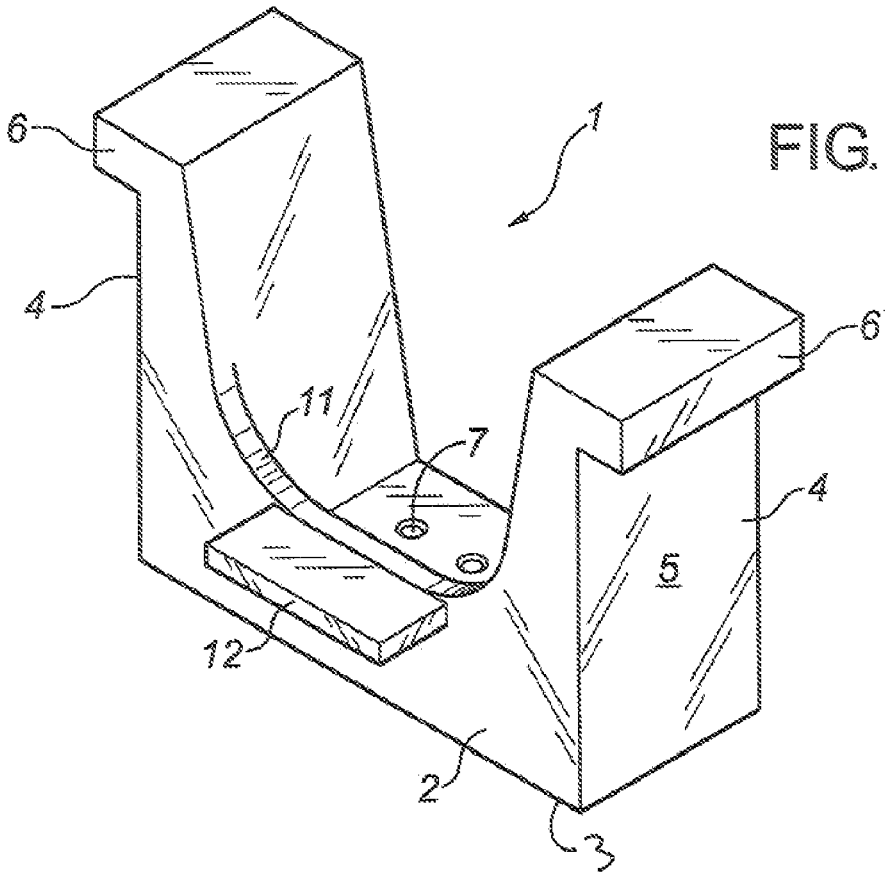
FIG. 3 is a perspective view depicting the bracket of FIG. 1.
Figure 4:
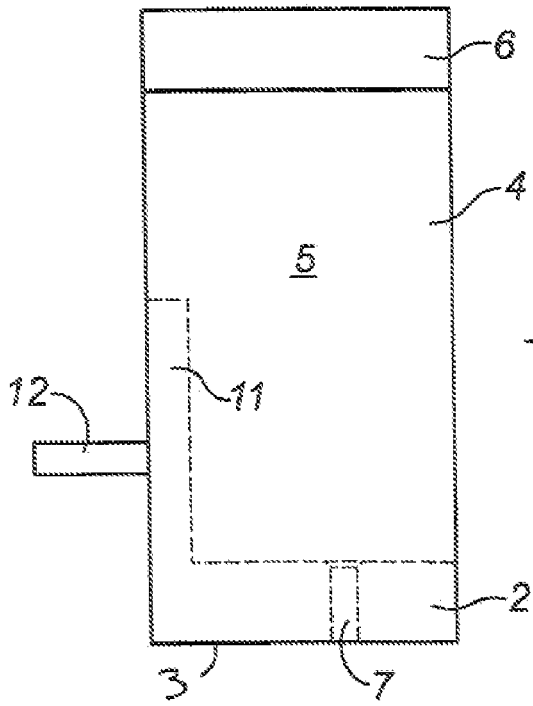
FIG. 4 is a bottom plan view depicting the bracket of FIG. 1.
Figure 5:
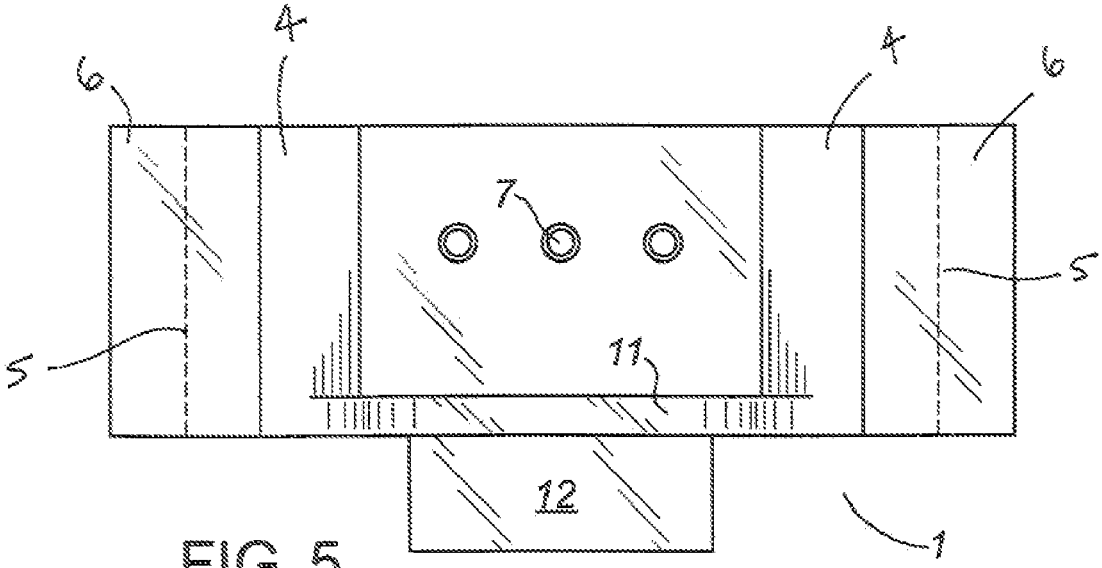
FIG. 5 is a front elevational view depicting the bracket of FIG. 1.
Figure 6:
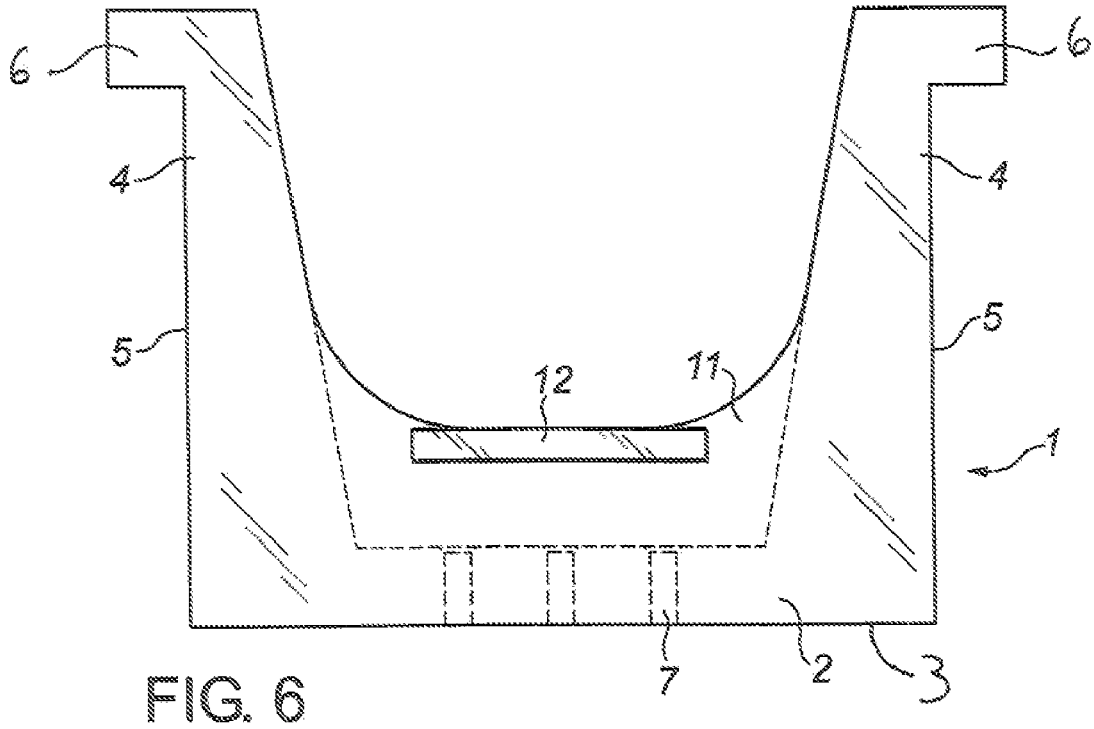
FIG. 6 is a side elevational view depicting the bracket of FIG. 1.

In the illustrated embodiment, panel-supporting surface 5 is of a dimensional length such that the pre-installation angle is a slight angle off of vertical thereby requiring only minimal movement to move the sheet material up against the wall frame so it can be secured to the wall frame as shown in FIG. 2A. After panel 13 has been affixed to studs 10, brackets 1 can be removed by extracting fasteners 8. This process can then be repeated until the required area is completely covered by sheeting.

In a representative embodiment, bracket 1 can be formed of injection molded plastic to provide low manufacturing cost and ease of use. It should be obvious to those skilled in the art, however, that other suitable materials having properties similar to that of injection molded plastic may be used to form the bracket of the present invention.

Figure 7:
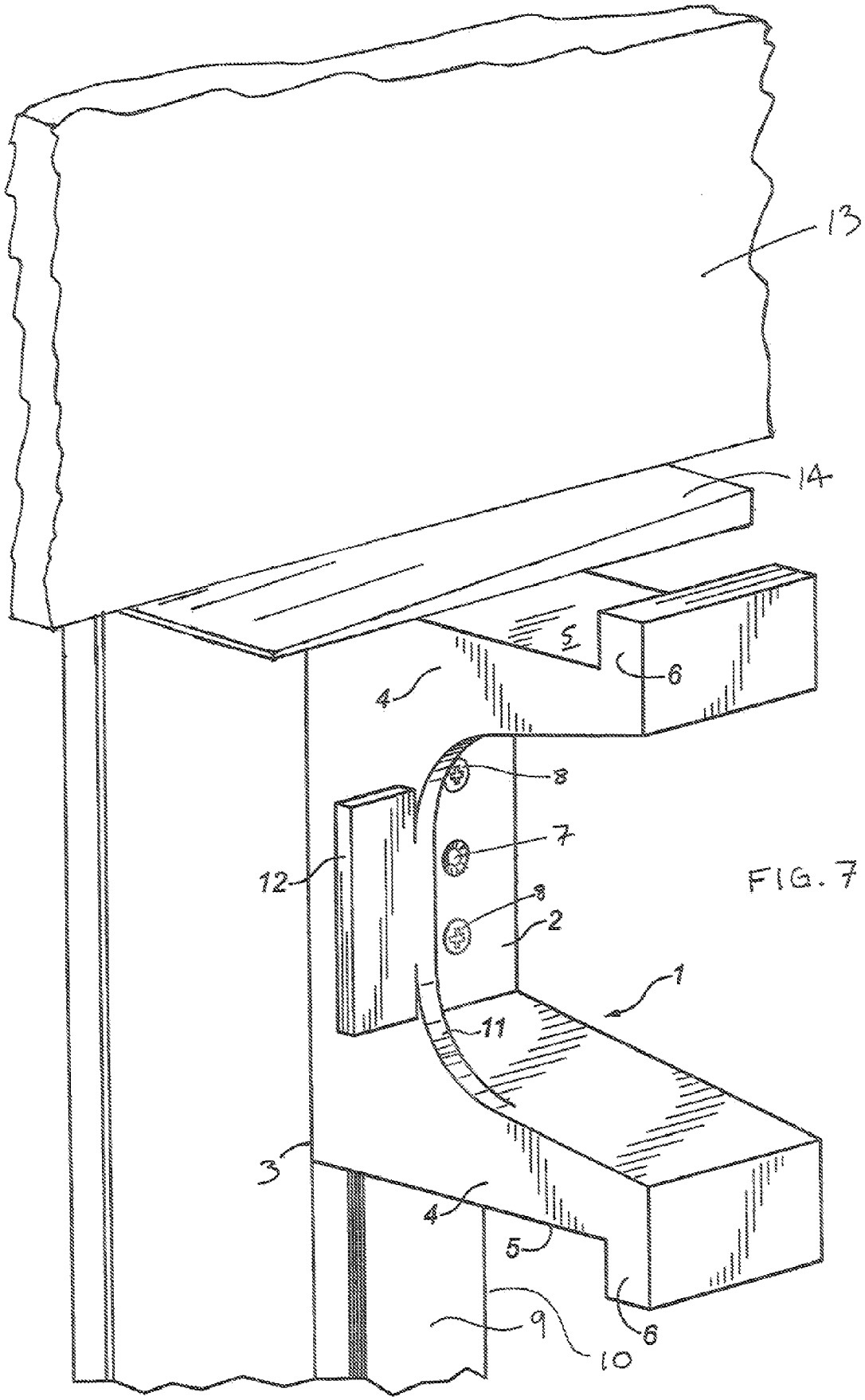
FIG. 7 is a side elevational view depicting the bracket of FIG. 1 mounted on a stud supporting a building material sheet with a wedge inserted between the bottom edge of the sheet and the bracket.

Referring to FIG. 7, bracket 1 is shown temporarily fastened to stud 10 and supporting panel 13 at a pre-installation position. Wedge 14 is provided to insert between the bottom edge of panel 13 and panel-support surface 5 of bracket 1 to raise or shim panel 13 to an installation position. In the illustrated embodiment, wedge 14 is inserted between panel 13 and surface 5 from the right side of bracket 1 although it should be obvious to those skilled in the art that wedge 14 can be inserted from the left side of bracket 1. Once panel 13 is so positioned, it can be fastened to stud 10 by an installer. After installation, wedge 14 can be removed along with bracket 1 for use in installing another panel 13 at another location. In one embodiment, wedge 14 can be made of injection-molded plastic although it should be obvious to those skilled in the art that any number of suitable materials can be used for wedge 14 including, but not limited to, wood and metal. In a representative embodiment, wedge 14 can be approximately 6 inches long, up to 2 inches wide and have a leading edge of approximately ⅛ inch thick. The angle of wedge 14 can be of any suitable angle for raising a panel of sheet material. In one embodiment, wedge 14 can have an angle of approximately 6 degrees.

Although a few preferred embodiments have been shown and described, it will be appreciated by those skilled in the art that various changes and modifications might be made without departing from the scope of the invention. The terms and expressions used in the preceding specification have been used herein as terms of description and not of limitation. There is no intention in the use of such terms and expressions of excluding equivalents of the features shown and described. The scope of the invention is defined and limited only by the claims that follow.

I claim:

1. A method for installing sheet material at an elevated position on a wall frame of the type including one or more wall frame studs, the method comprising the steps of:

a) providing a bracket, comprising:

i) an elongate base having an upper end, a lower end and a contact surface extending therebetween for abutting against the wall frame stud, the base having a width that substantially corresponds to the width of the wall frame stud, ii) the base intersected by one or more holes through which a fastener can be driven into the wall frame stud to attach the bracket to the wall frame stud, iii) a first L-shaped support arm disposed on the base, the first support arm extending outwardly and away from the upper end of the base, the first support arm dimensioned to support the sheet material in an angular pre-installation position, the first support arm further comprising a first panel-retaining lip, iv) a second L-shaped support arm, the second support arm being vertically spaced-apart from the first support arm, the second support arm extending outwardly and away from the lower end of the base and generally parallel to the first support arm, the second support arm dimensioned to support the sheet material in the angular pre-installation position, the second support arm further comprising a second panel-retaining lip, and v) a first flange extending between and joining the first and second support arms along one side of the base to form a gusset therebetween, the first flange extending outwardly and away from the base and the wall frame stud;

b) fastening the bracket to the wall frame stud with the fastener driven through the hole into the wall frame stud whereby the support arms are extended outwardly from the base and the wall frame stud;

c) placing the sheet material on the bracket whereby the lower edge of the sheet material is resting on the upper of the first and second support arms against its panel-retaining lip at a pre-installation off-vertical angled position;

d) moving the sheet material to an installation position; and e) fastening the sheet material to the wall frame.

2. The method as set forth in claim 1 further comprising the step of placing a wedge between the lower edge of the sheet material and the first support arm whereby the sheet material is moved to the installation position.

3. The method as set forth in claim 1 further comprising the step of unfastening the bracket from the wall frame stud.

4. The method as set forth in claim 3 further comprising the steps of moving the bracket to another wall frame stud and repeating steps b) to e) of claim 1 to enable the installation of another piece of sheet material.

5. The method as set forth in claim 1 further comprising the steps of providing another of the bracket and fastening the another bracket to another wall frame stud of the wall frame whereby the sheet material is placed on both of the brackets.

6. The method as set forth in claim 1 wherein the bracket further comprises a second flange that extends outwardly and away from the first flange to provide means for grasping the bracket, the second flange extending generally perpendicular to the first flange.

7. The method as set forth in claim 1 wherein the bracket is a unitary structure made of a plastic material.

* * * * *